US005085420A

United States Patent [19]

Sata

[11] Patent Number: 5,085,420

[45] Date of Patent: Feb. 4, 1992

[54] SHEET FEEDING APPARATUS

[75] Inventor: Junichi Sata, Yokohama, Japan

[73] Assignee: Canon Kabushiki Kaisha, Tokyo, Japan

[21] Appl. No.: 553,412

[22] Filed: Jul. 17, 1990

[30] Foreign Application Priority Data

Jul. 18, 1989 [JP] Japan ..... 1-186941
Sep. 5, 1989 [JP] Japan ..... 1-228394

[51] Int. Cl.[5] ..... B65H 3/06

[52] U.S. Cl. ..... 271/114; 271/116; 271/118; 271/122; 271/242

[58] Field of Search ..... 271/114, 116-118, 271/121, 122, 124, 125, 110, 10, 242

[56] References Cited

U.S. PATENT DOCUMENTS 3,961,786 6/1976 Yanker ..... 271/10 X
4,709,911 12/1987 Saiki et al. ..... 271/122 X
4,801,134 1/1989 Yokoyama et al. ..... 271/112
4,852,868 8/1989 Fukui et al. ..... 271/122
4,863,085 9/1989 Takenouchi et al. ..... 226/92

FOREIGN PATENT DOCUMENTS 0080869 6/1983 European Pat. Off. .
3243269 5/1984 Fed. Rep. of Germany .
3718644 12/1987 Fed. Rep. of Germany .
108636 6/1984 Japan ..... 271/10
295946 12/1986 Japan ..... 271/117
2041816 9/1980 United Kingdom .
2125759 3/1984 United Kingdom .
2131351 6/1984 United Kingdom .

*Primary Examiner*—David H. Bollinger
*Attorney, Agent, or Firm*—Fitzpatrick, Cella, Harper & Scinto

[57] ABSTRACT

A sheet feeding apparatus is provided having a first rotary member for feeding a sheet material and a second rotary member arranged at a downstream side of the first rotary member in the sheet feeding direction, for further feeding the sheet material. A drive source rotates the first and second rotary members. A transmitter is adapted to be engaged to rotate the first rotary member in the sheet feeding direction and to be disengaged to stop the second rotary member, when the drive source is rotated in one direction. The transmitter is adapted to be disengaged to stop the first rotary member and to be engaged to rotate the second rotary member in the sheet feeding direction, when the drive source is rotated in the other direction. The rotation of the first rotary member is prohibited in the sheet feeding direction at the start of rotation of the drive source in the other direction.

18 Claims, 9 Drawing Sheets

SHEET FEEDING APPARATUS

BACKGROUND OF THE INVENTION

1. Field of the Invention

The present invention relates to a sheet feeding apparatus, and more particularly it relates to a sheet feeding apparatus used for a sheet feeding system of an image reading equipment such as a scanner, facsimile or the like.

2. Related Background Art

An image reading equipment using a conventional sheet feeding apparatus of this kind is shown in FIG. 1.

In FIG. 1, an image reading equipment 100 includes a first feeding means 105 comprising an entrance roller 102, a feed roller 103 and a separating roller 104, and a second feeding means 107 comprising a feed conveying roller against which a reading means 106 is urged, these first and second feeding means being disposed along an original feeding direction (through which an original 101 as a sheet is fed) at upstream and down stream sides, respectively. Incidentally, the reference numeral 108 denotes an original detecting sensor arranged between the first feeding means 105 and the second feeding means 107.

In a sheet feeding apparatus 109 so constructed, the original 101 is fed out toward the downstream side by rotating the feed roller 103 in a anticlockwise direction, and the a leading end of the original 101 is abutted against a contacting portion a between a contact glass S of an image sensor of contact type (constituting the reading means 106) and the second feeding means 107, and then the original is further fed to form a loop in the original for correcting the skew feed of the original, and thereafter, the reading and ejection of the original is effected by conveying the original by rotating the second feeding means 107 in an clockwise direction. During this operation, the separating roller 104 is always driven in an clockwise direction through a torque limiter (not shown) to prevent the double-feed of the originals.

However, in the conventional sheet feeding mechanism utilizing the friction of the rollers, the loop in the original (sheet) can often not be formed in accordance with the conditions of the material of the original, the coefficient of friction of the rollers and the change thereof, the urging force acting on the friction roller and/or the distance between the friction roller and an sheet outlet.

Further, in such sheet feeding mechanism, the feed roller 103 incorporates a one-way clutch therein for transmitting a driving force of the feed roller to only one direction (original feeding direction, during the feeding of the original). However, conventional one-way clutches transmit a little driving force even in a reverse direction (to which the driving force should not be transmitted) (i.e., original returning direction, during the conveying of the original for reading). Further, the separating roller 104 is always driven through the torque limiter in the original returning direction.

Consequently, before the conveying roller of the second feeding means 107 is driven in the original feeding direction to pinch the leading end of the original and to convey the original for the reading thereof, the feed roller 103 and/or separating roller 104 often causes the leading end of the original to move back from a position where the leading end has been abutted against the contacting portion a, thus arising the erroneous feeding or poor feeding.

In order to prevent such poor feeding, a technique in which, when the original is fed by the rotation of the feed roller 103, the conveying roller 107 is also driven, and the feed roller 103 is stopped after the conveying roller 107 has pinched the leading end of the original has been proposed. However, in this case, there arose a problem that the skew feed of the original occurred because the posture of the original could not be corrected before the conveying of the original.

SUMMARY OF THE INVENTION

The present invention aims to eliminate the above-mentioned conventional drawbacks, and has an object to provide a sheet feeding apparatus which can prevent the application of a force in as sheet returning direction until a second feeding means can positively convey a sheet fed by a first feeding means.

In order to achieve the above object, in the present invention, the rotation of the first feeding means in the sheet returning direction is prevented until the second feeding means can positively convey the sheet.

More particularly, in order to achieve the above object, the present invention provides a sheet feeding apparatus comprising a first feeding rotary means abutting against a sheet and a second feeding rotary means abutting against the sheet which are disposed along a sheet feeding direction at upstream and downstream sides, respectively, and wherein the sheet is abutted against the second feeding rotary means by driving the first feeding rotary means, and after a predetermined time period has been elapsed the second feeding rotary means is driven to convey the sheet toward a downstream side, and further wherein means for driving the first feeding rotary means in the sheet feeding direction for a predetermined time after the second feeding rotary means has been driven.

According to the present invention, with the arrangement as mentioned above, the first feeding rotary means can be driven in the sheet feeding direction until the second feeding rotary means positively pinches the sheet fed by the first feeding rotary means. Accordingly, the sheet can be positively received from the first feeding rotary means to the second feeding rotary means regardless of the material of the sheet, the friction of coefficient of the first feeding rotary means and/or the change in such friction of coefficient, with the result that the sheet abutted against the second feeding rotary means is prevented from moving back, thus avoiding the poor feeding of the sheet.

According to another aspect of the present invention, in order to achieve the above object, there is provided a sheet feeding apparatus comprising a first feeding rotary means abutting against a sheet and a second feeding rotary means abutting against the sheet which are disposed along a sheet feeding direction at upstream and downstream sides, respectively, and wherein the sheet is abutted against the second feeding rotary means by driving the first feeding rotary means, and after a predetermined time has been elapsed the second feeding rotary means is driven to convey the sheet toward a downstream side, and further wherein means for stopping the first feeding rotary means for a predetermined time after the second feeding rotary means has been driven.

As mentioned above, for example, by the use of the normal and reverse rotations of a first reversible driving force, it is possible to positively receive the sheet from the first feeding rotary means to the second feeding rotary means, by driving the first and second feeding rotary means, and by stopping the first feeding rotary means until the second feeding rotary means can positively convey the sheet fed by the first feeding rotary means.

BRIEF DESCRIPTION OF THE DRAWINGS

FIGS. 2 to 7F shows a sheet feeding apparatus according to a preferred embodiment of the present invention, where FIG. 2 is a schematic perspective view, FIGS. 3 and 4 are elevational sectional views, FIG. 5 is a perspective view of a transmission portion of a rotary shaft, FIG. 6 is a perspective view showing a clutch spring in the transmission portion, and FIGS. 7A to 7F are schematic sectional views showing the operation of the apparatus;

DESCRIPTION OF THE PREFERRED EMBODIMENT

The present invention will now be explained in connection with embodiments thereof with reference to the accompanying drawings.

First of all, a preferred embodiment shown in FIGS. 2 to 7 will be described.

Figure 1:
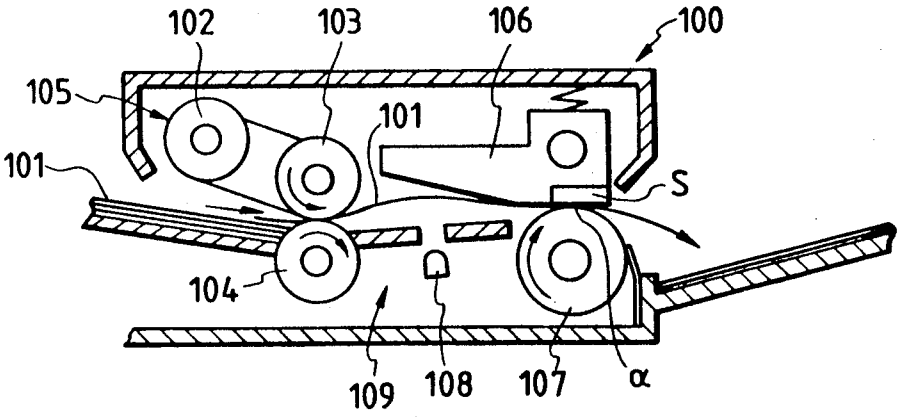
FIG. 1 PRIOR ART
FIG. 1 is a schematic front sectional view of a conventional sheet feeding apparatus.
Figure 2:
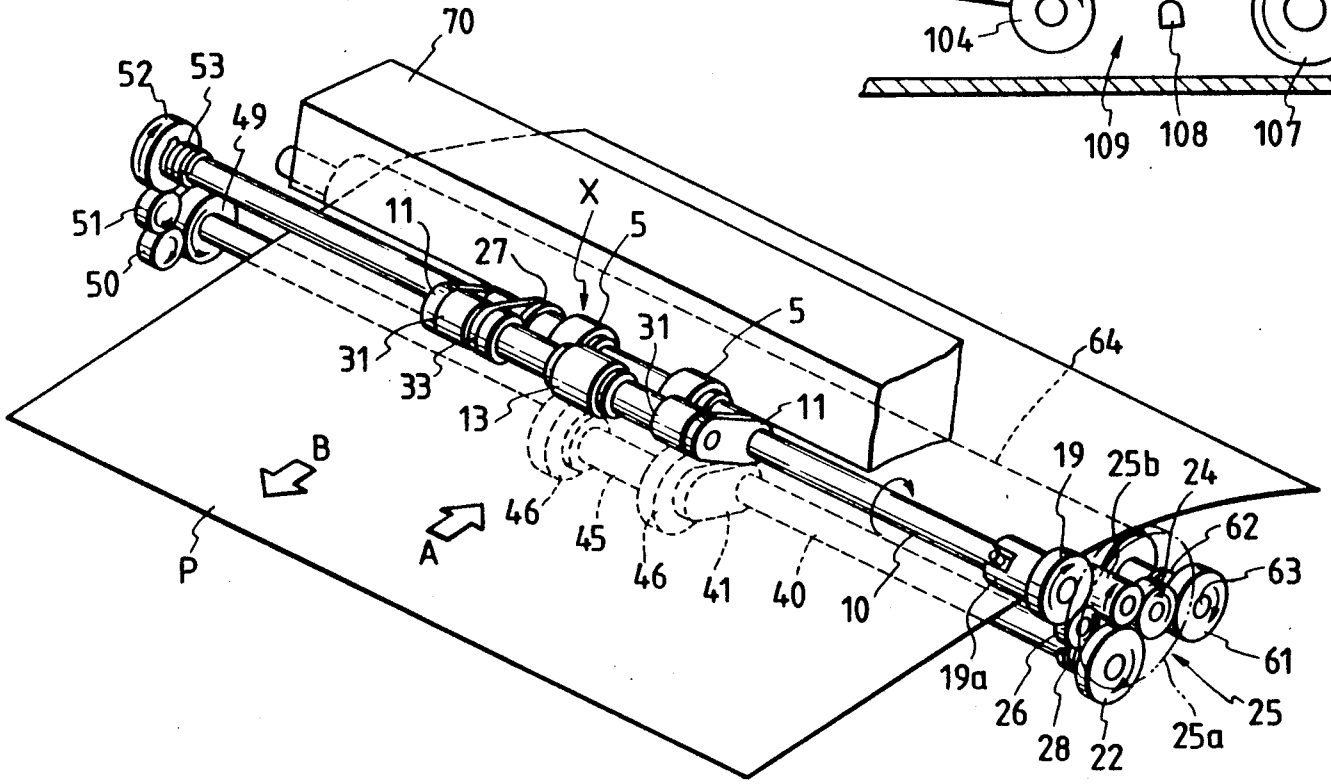
Figure 3:
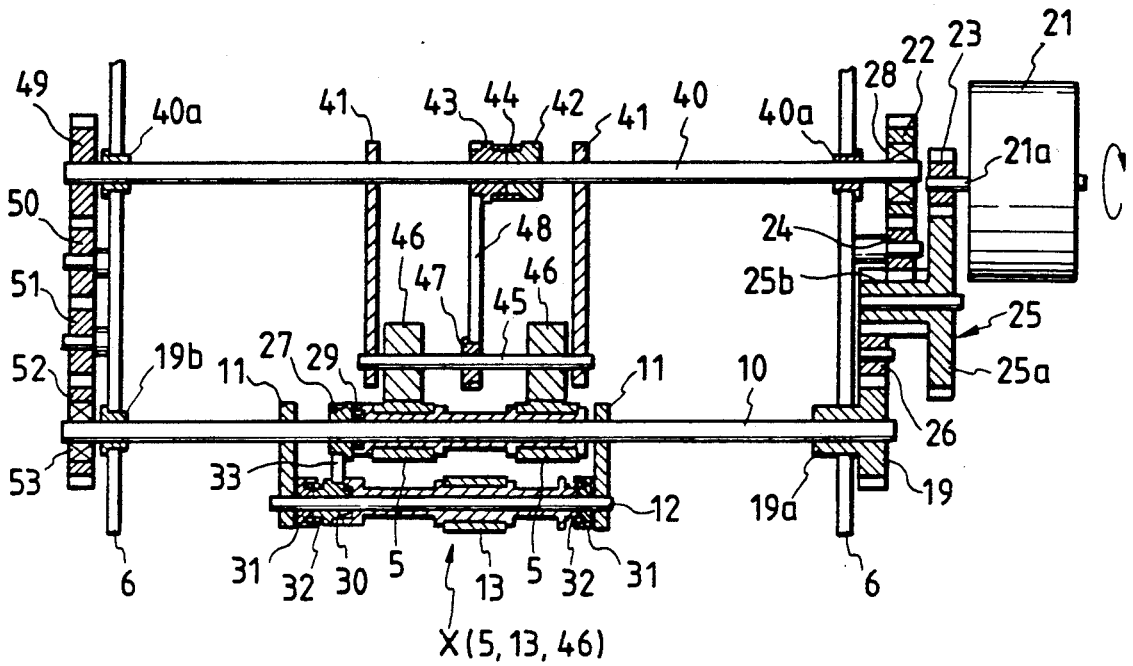
Figure 4:
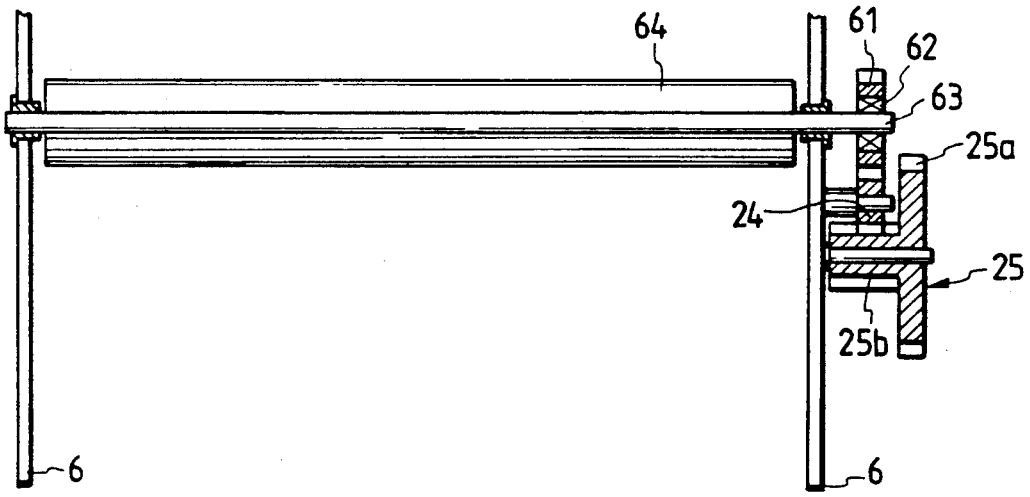

FIG. 2 is a perspective view of a main portion of a sheet feeding apparatus according to the preferred embodiment, and FIGS. 3 and 4 are elevational sectional views of a driving mechanisms of the sheet feeding apparatus.

Figure 5:
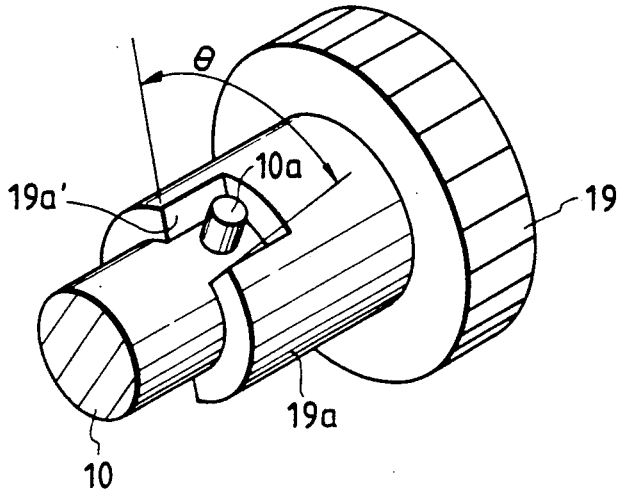
Figure 6:
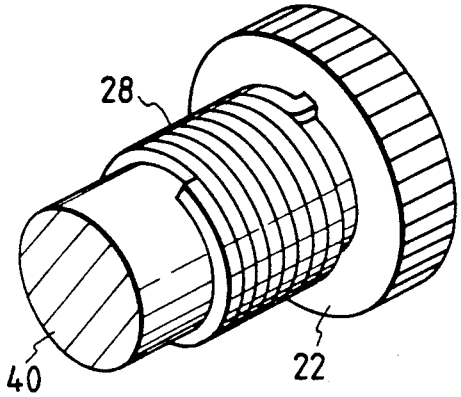

In FIGS. 2 to 4, a rotary shaft 10 fitting a gear 19 thereon is rotatably supported by a parallel frame 6 through a sleeve portion 19*a* of the gear 19. And, as shown in FIG. 5, the rotary shaft 10 has a pin 10*a* which is loosely received in a notch 19*a'* formed in the sleeve 19*a*. The other end of the rotary shaft 10 is rotatably supported by the frame 6 through a bearing 19*b*, and a gear 52 is attached to the other end of the rotary shaft through a spring clutch 53. The gear 52 is so arranged that a driving force from a driving source (described later) is not transmitted to a sheet feeding direction (shown by the arrow A) for feeding an original P as a sheet and the driving force can be transmitted to a reverse direction (shown by the arrow in FIG. 2). Further, the gear 19 is drivingly connected to a gear 23 fixedly mounted on an output shaft 21*a* of a motor 21 acting as the driving source attached to the frame 6, through a gear 26 and a larger gear portion 25*a* of a gear 25, whereby the gear 19 receives the driving force from the motor 21.

Further, feed rollers 5 and a pair of levers 11 are mounted on the rotary shaft 10, and a pulley 27 is fixed to the shaft 10. More particularly, the feed rollers 5 are connected to the rotary shaft 10 through a one-way clutch 29, so that the feed rollers 5 can receive the driving force from the motor 21 in the sheet feeding direction A. In the reverse direction opposite to the sheet feeding direction, the driving force from the motor is not transmitted to the feed rollers by the presence of the one-way clutch 29.

A rotary shaft 12 is rotatably mounted on the levers 11 substantially in parallel with the rotary shaft 10. An entrance roller 13, pulley 30 and friction rollers 31 are fixedly mounted on the rotary shaft 12. Compression springs 32 are disposed between the pulley 30 and the friction roller 31 and between the entrance roller 13 and the friction roller 31, respectively, so that the friction rollers 31 are urged against the levers 11 by the compression springs 32. Further, the pulley 30 and the pulley 27 are connected to each other by a timing belt 33 so that the driving force is transmitted from the rotary shaft 10 to the entrance roller 13. The left (FIG. 3) friction roller 31, pulley 30, entrance roller 13 and right friction roller 31 are engaged by each other through engagement portions (not shown), respectively, so that the pulley 30, entrance roller 13 and friction rollers 31 can be rotated altogether. Accordingly, when the rotary shaft 10 is rotated in a direction shown by the arrow in FIG. 2, the levers 11 are rotated in the clockwise direction to separate the entrance roller 13 from the original; whereas, when the rotary shaft 10 is rotated reversely, the levers 11 are rotated in the anticlockwise direction to urge the entrance roller 13 against the original.

Further, a rotary shaft 40 is rotatably supported by the frame 6 through bearings 40*a* and is spaced apart from the rotary shaft 10 by a predetermined distance. A gear 22 is connected to one end of the rotary shaft 40 through a spring clutch 28 (refer to FIG. 6) so that the strong driving force is transmitted to a sheet (original) returning direction (shown by the arrow B in FIG. 2). A slipping torque of the spring clutch 28 (slipping torque of the spring clutch 28 in a loosing direction) has a torque value greater than a value of a torque required to rotate separating rollers 46 (described later) in the sheet (original) feeding direction A. The gear 22 is connected to a smaller gear portion 25*b* of the gear 25 through a gear 24. The spring clutch 28 can rotate the separating rollers 46 even in the original feeding direction, other than the case when the rotary shaft 40 is rotated in the original returning direction by a gear train 49 and the like.

Further, on the rotary shaft 40, a drum 42 is fixedly mounted, and a pulley 43 and two support plates 41 are rotatably mounted. The drum 42 is connected to the pulley 43 through a spring clutch 44. The support plates 41 rotatably support a rotary shaft 45 substantially in parallel to the rotary shaft 40. A pair of separating rollers 46 and a pulley 47 are fixedly mounted on the rotary shaft 45. The pulley 47 is connected to the pulley 43 through a timing belt 48 so that these pulleys are driven in the original returning direction by the spring clutch 44 with a predetermined allowable or tolerance value (slipping torque). The separating rollers 46 are urged upwardly to be pressed against the feed rollers 5 by means of springs (not shown).

Incidentally, a gear 49 fixedly mounted on the other end of the rotary shaft 40 is connected to a gear 52 through gears 50 and 51. The feed rollers 5, entrance roller 13 and separating rollers 46 constitute a first feeding means X.

Accordingly, the separating rollers 46 receive the driving force in the anti-clockwise direction (FIG. 7) through the gears 23, 25, 24, 22 and the spring clutch 28 when the motor 21 is rotated in the normal direction (FIG. 3), and receive the driving force in the clockwise direction through the gears 23, 25, 26, 19, rotary shaft 10, spring clutch 53 and gears 52, 51, 50, 49 when the motor is rotated in the reverse direction, and (since the force transmitted from the gear train 52, 51, 50, 49 to the rotary shaft 40 is greater than the force transmitted from the gear train 24, 22 and spring clutch 28 to the rotary shaft 40) is always driven in the original returning direction B with a predetermined allowable value (slipage torque of the spring clutch 44). However, when a given time is elapsed after the motor has been changed from the normal rotation to the reverse rotation, that is to say, when the driving force is transmitted from the gear 19 to the rotary shaft 10 in a driving force transmitting path to the separating rollers 46 during the reverse rotation of the motor 21, since the gear 19 has a given play angle $\theta$, the driving force is not transmitted to the rotary shaft 10, and the gear 19 is rotated in the original feeding direction by the slipping torque of the spring clutch 28 through the gears 23, 25, 24 and 22. Thereafter, when the pin 10*a* is engaged by the lateral surface of the notch 19*a'* the driving force is transmitted from the gear 19 to the rotary shaft 10, with the result that the rotary shaft 40 (separating rollers 46) is rotated in the original returning direction through the gear train 52, 51, 50, 49 by overcoming the slipping torque of the spring clutch 28.

A second feeding means comprising a conveying roller 64 is rotatably mounted on the frame 6 at a downstream side of the feed rollers 5 and the separating rollers 46 with respect to the original feeding direction A. A gear 61 is connected through a one-way clutch 62 to a rotary shaft 63 to which the conveying roller 64 is fixed, which gear 61 is meshed with the gear 24. An image sensor 70 of contact type acting as a reading means is pressed against the conveying roller 64 along a reading line. Incidentally, the spring clutch 53 is designed that the driving force from the driving source is not transmitted to the original feeding direction and is transmitted to the reverse direction.

Next, the operation of the sheet feeding apparatus according to the illustrated embodiment will be explained.

Figure 7A:
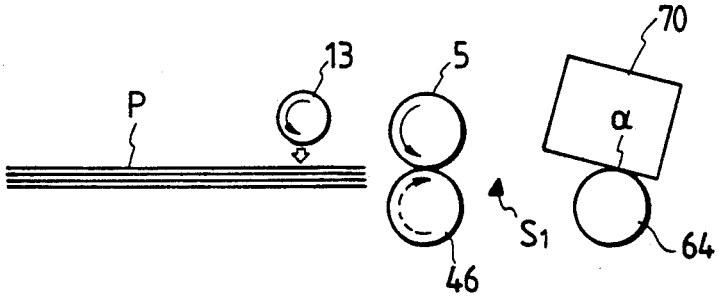

When the single motor 21 is rotated in the normal direction (shown by the arrow in FIG. 3) in response to a sheet feeding command signal from a controller (not shown), the entrance roller 13 and feed rollers 5 are rotated in the directions shown by the arrows in FIG. 7A, and at the same time the entrance roller 13 is lowered. Further, although the separating rollers 46 tend to rotate in the original returning direction (anti-clockwise direction), in this case, they are rotated in the direction shown by the broken arrow by following the rotation of the feed rollers 5, against the slipping torque of the spring clutch 44.

Figure 7B:
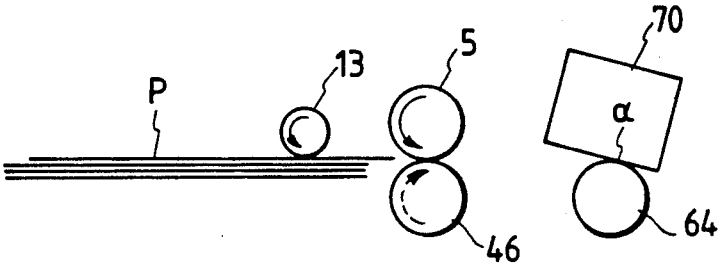

In FIG. 7B, the entrance roller 13 abuts against an uppermost original P on a sheet stack stored on a support and feeds out the original P from the support. If two or more originals P are fed out, the separating rollers 46 are rotated in the anti-clockwise direction by the slipping force of the spring clutch 44 to return the original other than the uppermost one P.

Figure 7C:
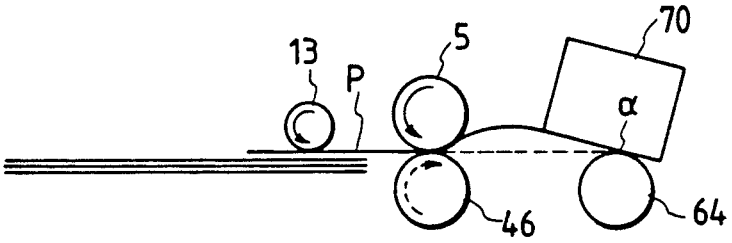

In FIG. 7C, a leading end of the uppermost original P fed by the feed rollers 5 is abutted against a contacting portion a formed between the conveying roller 64 (now stopped) and the image sensor 70 of contact type. Further, on the basis of a detection signal from an original end detecting sensor $S_1$ arranged between the feed rollers 5 and the conveying roller 64, the original P is still fed until it forms a loop therein, thereby correcting the posture (particularly, the skew-feed) of the original. In this case, the separating rollers 46 are being rotated in the clockwise direction by following the rotation of the feed rollers 5 for feeding the original P to the right. Also, in this case, the original P sometimes cannot form the loop therein in accordance with the conditions of the material of the original P, surroundings and/or the feeding force of the feed rollers 5, and keeps a straight condition (shown by the broken straight line in FIG. 7C).

Figure 7D:
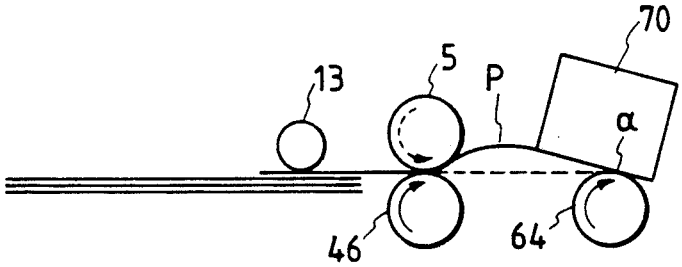

In FIG. 7D, after the feeding of the original is finished, the single motor 21 is rotated in the reverse direction to rotate the conveying roller 64 in the direction shown by the arrow, thereby pinching the original between the image sensor 70 and the conveying roller 64. When the motor 21 starts to be rotated in the reverse direction, since the force for rotating the rotary shaft 40 through the gear train 23, 25, 24, 22 and the spring clutch 28 is greater than the force required for rotating the gear train 49–52, spring clutch 53 and the rotary shaft 10, the separating rollers 46 are rotated in the direction shown by the broken arrow by a predetermined time period (time period required for engaging the side wall of the notch 19*a'* against the pin 10*a*), thereby further pushing the original to the right. Further, although the feed rollers 5 do not receive the driving force by the action of the clutch 29, they are rotated in the anti-clockwise direction by following the movement of the original P. Now, the driving force is not transmitted to the entrance roller 13.

Accordingly, regardless of the material of the original, the coefficient of friction of the separating rollers 46 and the change in the urging force of the separating rollers, the original P can positively be received from the feed rollers 5 and separating rollers 46 to the conveying roller 64, thus preventing the poor feeding of the original which will be caused when the original is moved back to separate from the contacting portion a. Thereafter, when a predetermined time is elapsed, although the rotary shaft 40 tends to rotate reversely through the gear train 52, 51, 50, 49, it is rotated in the clockwise direction by following the movement of the original P.

Figure 7E:
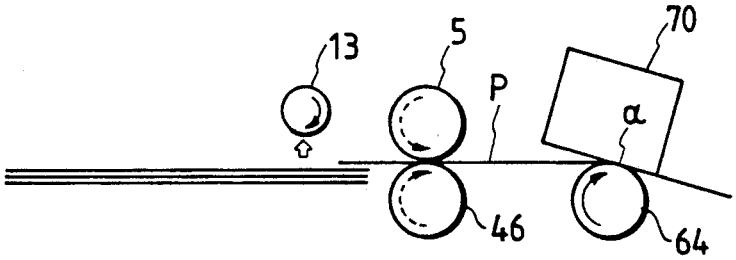

In FIG. 7E, the reading operation is initiated while conveying the original P by the rotation of the conveying roller 64 with pinching the original between the image sensor 70 and the conveying roller 64. In this case, the feed rollers 5 (which do not receive the driving force, in this condition) are rotated by following the movement of the original P, and the separating rollers 46 (which tend to rotate reversely) are also rotated by following the movement of the original P. The entrance roller 13 is rotated in the direction shown by the arrow in response to the clockwise rotation of the rotary shaft 10 and is retarded (lifted) from the original P.

Figure 7F:
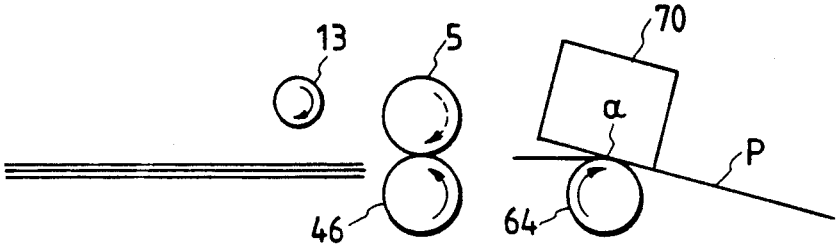

In FIG. 7F, when a trailing end of the original P has passed through between the feed rollers 5 and the separating rollers 46, the separating rollers 46 are rotated in the original returning direction as shown by the arrow, and the feed rollers 5 are rotated by following the rotation of the separating rollers 46. Further, after the trailing end of the original P has passed through between the image sensor 70 and the conveying roller 64, the reading operation of the original is finished.

Thereafter, when a predetermined time is elapsed after the trailing end of the original has passed through the sensor $S_1$, the single motor 21 is rotated in the normal direction again to restore the condition shown in FIG. 7A. In this way, the feeding and reading the original P can be repeated.

Incidentally, with respect to the gear 19 provided in the driving transmission portion, it is possible to give the same function to a front stage of the gear 19 regarding the motor 21 or the driving force may be interrupted by using an appropriate solenoid.

Figure 8:
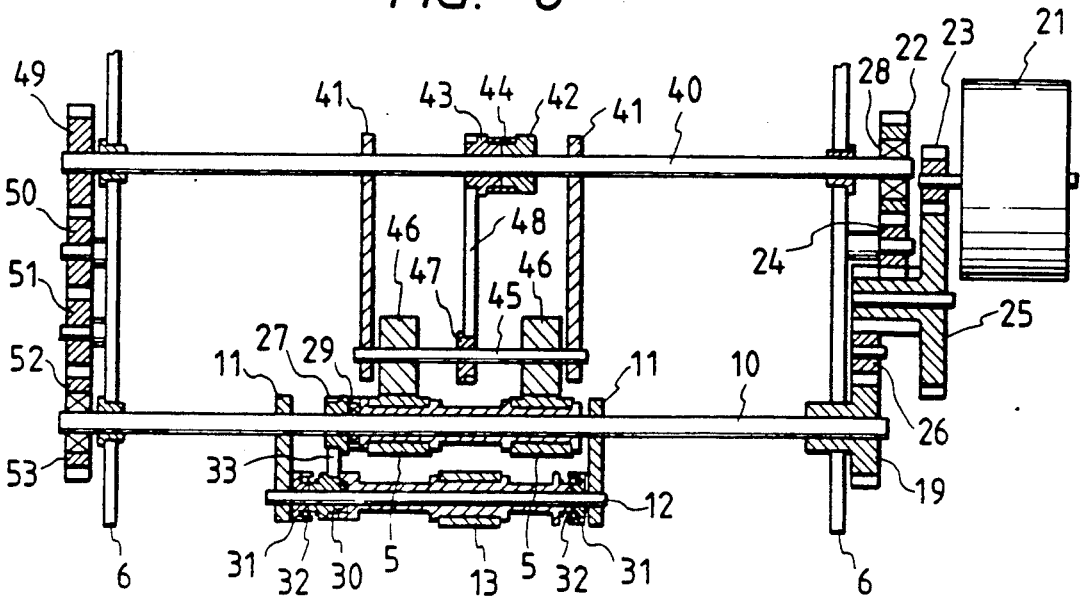
FIG. 8 is an elevational sectional view of a sheet feeding apparatus according to a second embodiment of the present invention.

Next, another or second embodiment of the present invention will be explained with reference to FIGS. 8 and 9. Incidentally, the explanation regarding the same elements as those shown in FIGS. 1 to 5 will be omitted.

The characteristic or feature of this second embodiment is that the design of a spring clutch 28 is changed so that the driving force in the normal direction is not transmitted to the separating rollers 46. To this end, in the construction of the spring clutch 28, a slipping torque (slipping torque of the spring clutch 28 in a loosing direction) is selected or set to have a value lower than the torque required for rotating the separating rollers 46 in the original feeding direction.

Consequently, when the gear 22 is rotated in the reverse direction, the rotation of this gear is transmitted to the rotary shaft 40 to rotate the separating rollers 46 in the reverse direction; but, when the gear 22 is rotated in the normal direction, the rotation thereof is not transmitted to the rotary shaft 40.

Accordingly, although the separating rollers 46 are rotated reversely when the motor 21 is rotated in the normal direction, when the motor 21 is rotated in the reverse direction, the separating rollers 46 are temporarily stopped since the gear train 52, 51, 50, 49 is not rotated due to the play $\theta$ between the gear 19 and the rotary shaft 10 and the rotary shaft 40 is not rotated by the action of the spring clutch 28.

Figure 9A:
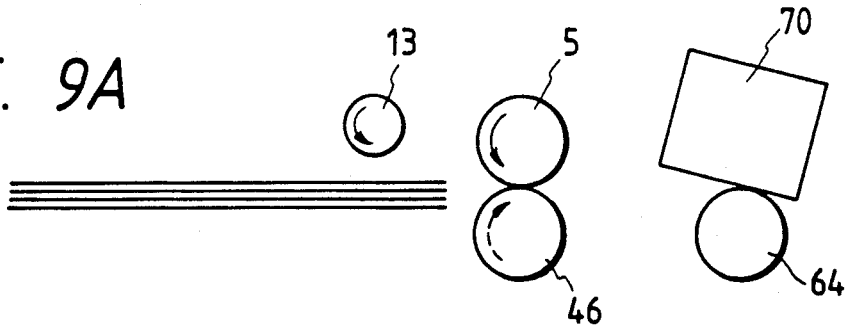
FIGS. 9A to 9F are schematic sectional view showing the operation of the apparatus of FIG. 8.
Figure 9B:
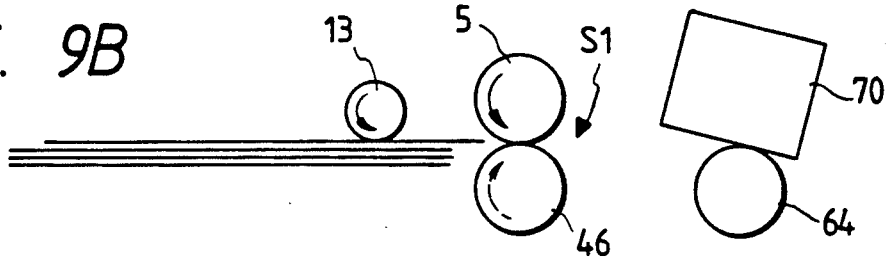
Figure 9C:
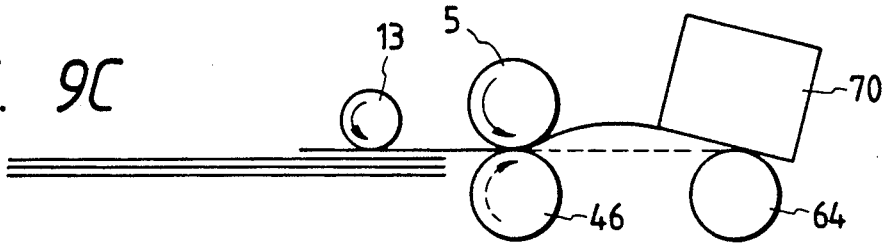
Figure 9D:
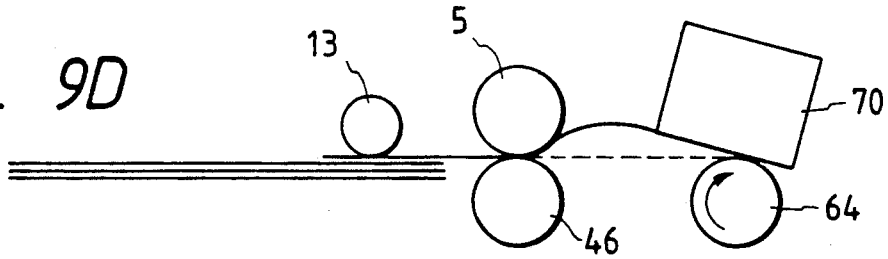

FIG. 9 shows the above-mentioned operation, wherein FIGS. 9A–9C, 9E and 9F correspond to FIGS. 7A–7C, 7E and 7F, respectively, but FIG. 9D differs from FIG. 7D.

The sheet (original) feeding operation regarding the second embodiment will be explained with reference to FIG. 9.

In FIG. 9A, when the single driving source (motor 21) is rotated in the normal direction in response to a sheet feeding command signal, the entrance roller 13 and feed rollers 5 are rotated in the directions shown by the arrows, and at the same time the entrance roller 13 is lowered by a rocking mechanism. Further, although the separating rollers 46 tend to rotate in the original returning direction, in this case, they are rotated in the direction shown by the broken arrow by following the rotation of the feed rollers 5, due to the presence of the spring clutch.

In FIG. 9B, the entrance roller 13 abuts against the uppermost original P on the sheet stack stored on the support and feeds out the original P from the support. If two or more originals P are fed out, the separating rollers 46 return the original other than the uppermost one P through the action of the spring clutch.

In FIG. 9C, a leading end of the uppermost original P fed by the feed rollers 5 is abutted against a contacting portion formed between the conveying roller 64 (now stopped) and the image sensor 70 of contact type. Further, on the basis of the detection signal from the original end detecting sensor $S_1$ arranged between the feed rollers 5 and the conveying roller 64, the original P is still fed until it forms a loop therein, thereby correcting the posture of the original. In this case, the original P sometimes cannot form the loop therein in accordance with the conditions of the material of the original P, surrounding and/or the feeding force of the feed rollers 5, and keeps a straight condition (shown by the broken straight line in FIG. 9C).

In FIG. 9D, after the feeding of the original is finished, the single driving source is rotated in the reverse direction to rotate the conveying roller 64 in the direction shown by the arrow, thereby pinching the original between the image sensor 70 and the conveying roller 64. In this case, the entrance roller 13, feed rollers 5 and separating rollers 46 are stopped. The time duration when these rollers are stopped corresponds to a time duration when the gear 19 is slipping on the rotary shaft 10.

Figure 9E:
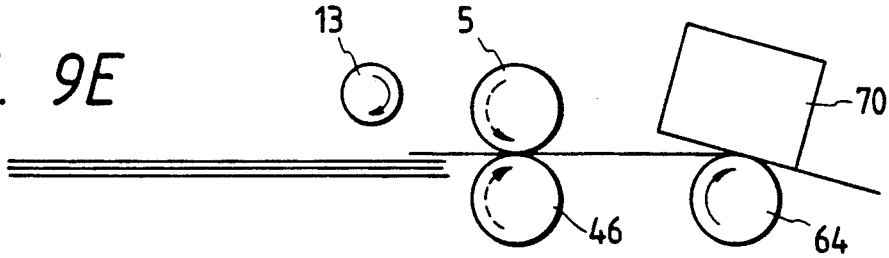

In FIG. 9E, the reading operation is initiated while conveying the original P by the rotation of the conveying roller 64 with pinching the original between the image sensor 70 and the conveying roller 64. In this case, the feed rollers 5 (which do not receive the driving force, in the is condition) are rotated by following the movement of the original, and the separating rollers 46 (which tend to rotate reversely through the gear 19, rotary shaft 10, gear train 52, 51, 50, 49 and rotary shaft 40) are also rotated by following the movement of the original. The entrance roller 13 is rotated in the direction shown by the arrow and is retarded (lifted) from the original by the action of the rocking mechanism.

Figure 9F:
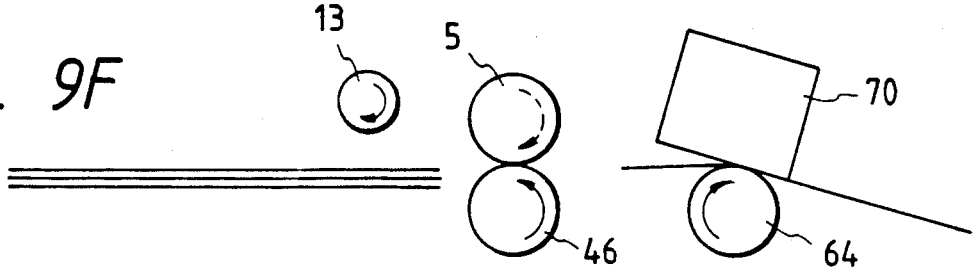

In FIG. 9F, when a trailing end of the original P has passed through between the feed rollers 5 and the separating rollers 46, the separating rollers 46 are released from the restrainment and are rotated in the original returning direction and the feed rollers 5 are rotated by following the rotation of the separating rollers 46. Further, after the trailing end of the original has passed through between the image sensor 70 and the conveying roller 64, the reading operation of the original is finished.

Thereafter, when the single driving source is rotated in the normal direction again, the condition shown in FIG. 7A is restored. In this way, the feeding and reading the original P can be repeated.

Next, a third embodiment of the present invention will be explained with reference to FIG. 10.

The characteristic of this third embodiment is that a sheet feeding apparatus is arranged in the sheet conveying line and can be stopped temporarily, wherein the motor Mo is commonly used.

Figure 10A:
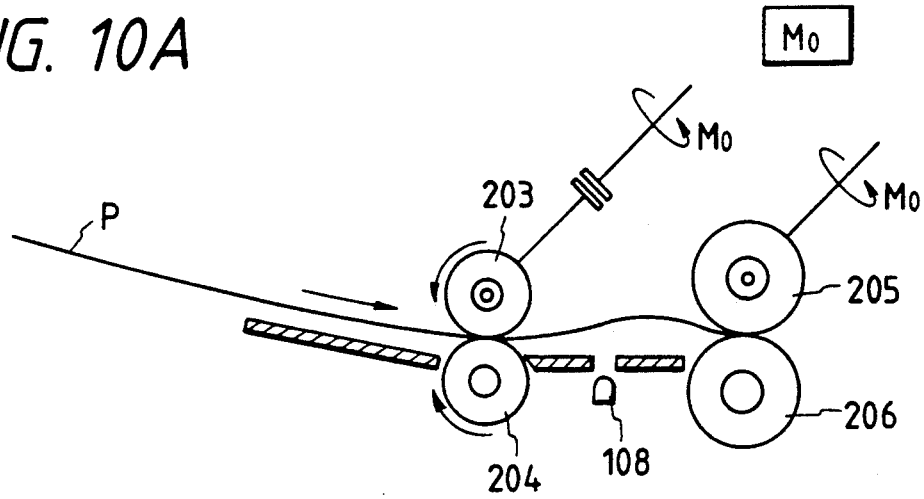
FIGS. 10A to 10C are explanatory views showing the operation of a sheet feeding apparatus according to a third embodiment of the present invention.
Figure 13:
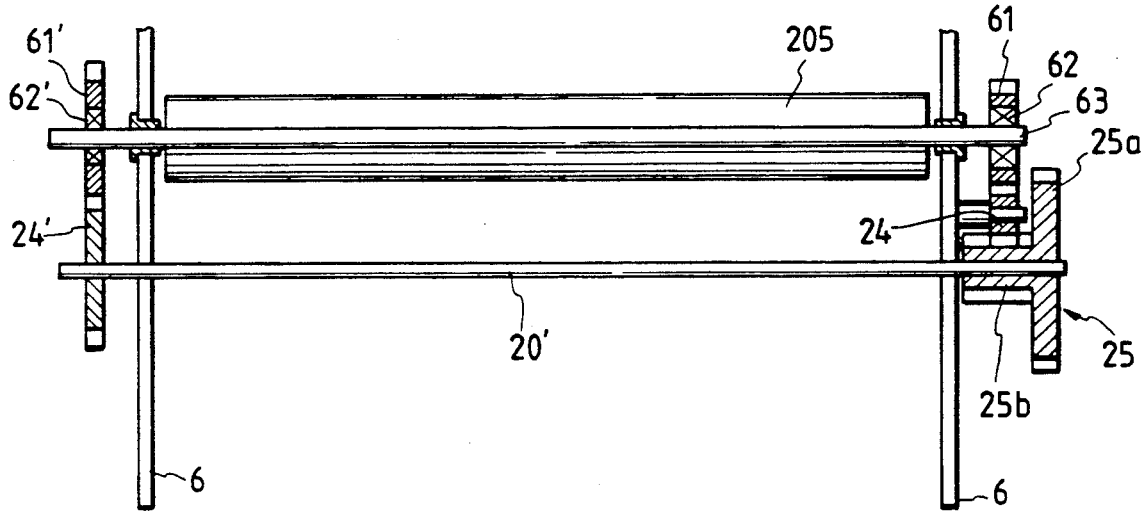
FIG. 13 is an elevational sectional view showing an alternative example of a gear train for driving rollers 205 and 206.

In FIG. 10A, a second pair of rotatably rollers 205, 206 are stopped by the action of a clutch (not shown), regardless of the rotation of the motor Mo. A first pair of rotatably rollers 203, 204 are being rotated in the sheet feeding direction. Thus, a loop is formed in a sheet P. Incidentally, the rollers 205, 206 may be rotated in a sheet returning direction, which can be effected by a gear train shown in FIG. 13. More particularly, in FIG. 13, a clutch 62' is engaged and disengaged, opposite to the engagement and disengagement of a clutch 62. Accordingly, a gear 61 is rotated when the gear 25 is rotated in the clockwise direction; whereas, a gear 61' is rotated when the gear 25 is rotated in the anti-clockwise direction.

Figure 10B:
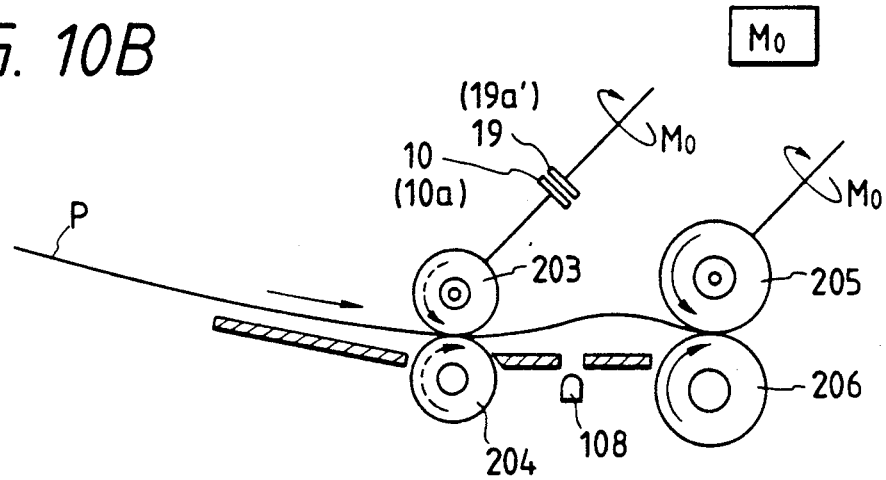

In FIG. 10B, when the motor Mo is rotated reversely, the second pair of rollers 205, 206 are rotated in the sheet feeding direction. In this case, since the driving force is not transmitted to the first pair of rollers 203, 204 due to the presence of relation between the notch 19*a'* and the pin 10*a* as similar to that shown in FIG. 5, these rollers 203, 204 are rotated in the anti-clockwise direction by following the movement of the sheet P.

Figure 10C:
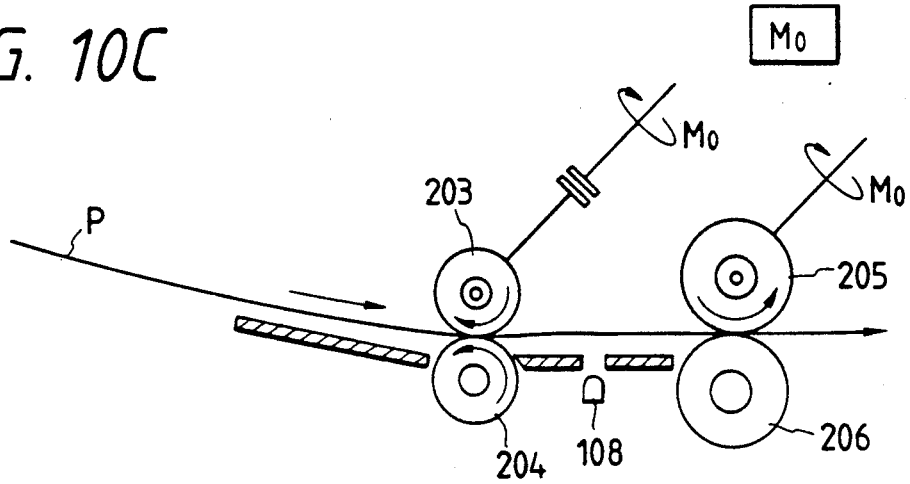

In FIG. 10C, when the motor is further rotated, the pin 10*a* is engaged by the notch 19*a'* to couple the roller 203 to the motor Mo, thus rotating the first pair of rollers 203, 204 in the clockwise direction. In this point, since the sheet P is positively pinched by the second pair of rollers 205, 206, the feeding of the sheet can be performed smoothly.

Next, a fourth embodiment of the present invention will be explained with reference to FIG. 11.

The characteristic of this fourth embodiment is that a sheet feeding apparatus is arranged in the sheet conveying line and are rotated in the sheet feeding direction, wherein the motor Mo is commonly used.

Figure 11A:
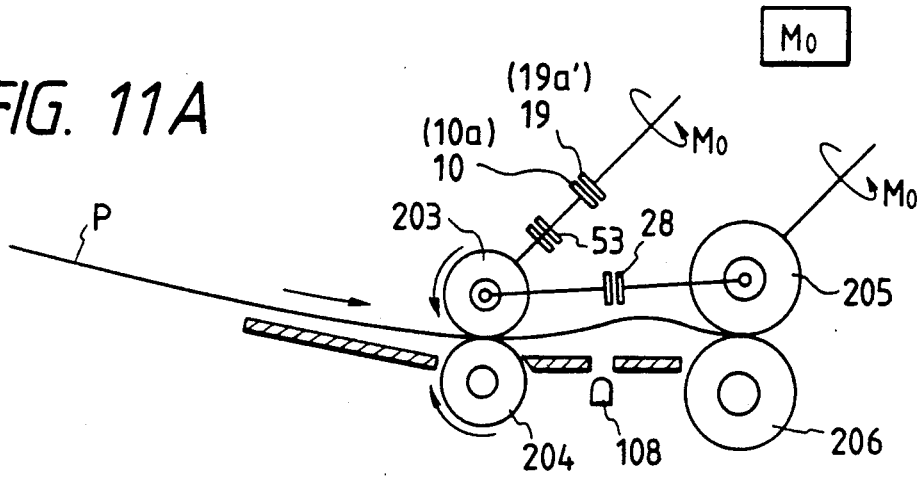
FIGS. 11A to 11C are explanatory views showing the operation of a sheet feeding apparatus according to a fourth embodiment of the present invention.

In FIG. 11A, a second pair of rotatably rollers 205, 206 are stopped by the action of a clutch (not shown), regardless of the rotation of the motor Mo. A first pair of rotatable rollers 203, 204 are being rotated in the sheet feeding direction. Thus, a loop is formed in a sheet P.

Figure 11B:
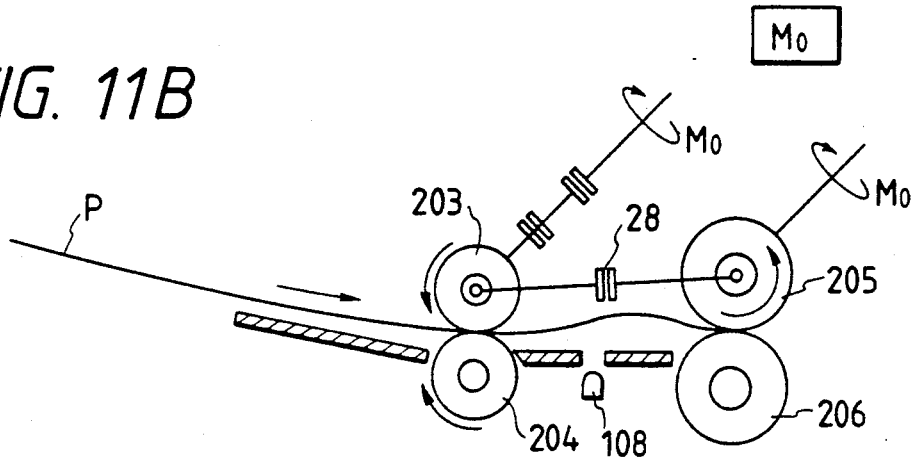

In FIG. 11B, when the motor Mo is rotated reversely, the second pair of rollers 205, 206 are rotated in the sheet feeding direction. In this case, although the driving force is not transmitted to the first pair of rollers 203, 204 due to the presence of relation between the notch 19*a'* and the pin 10*a* as similar to that shown in FIG. 5, since the rotation of the roller 205 is transmitted to the roller 203 through a clutch 28, these rollers 203, 204 are rotated in the anti-clockwise direction.

Figure 11C:
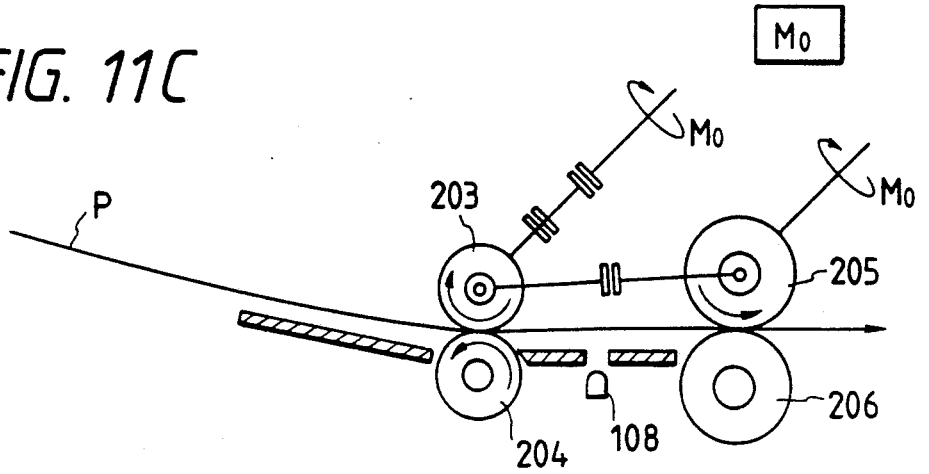

In FIG. 11C, when the motor is further rotated, the pin 10*a*is engaged by the notch 19*a'* to couple the roller 203 to the motor Mo, thus rotating the first pair of rollers 203, 204 in the clockwise direction by overcoming the rotational force of the clutch 28. In this point, since the sheet P is positively pinched by the second pair of rollers 205, 206, the feeding of the sheet can be performed smoothly.

Next, a fifth embodiment of the present invention will be explained with reference to FIG. 12. The characteristic of this fifth embodiment is that a sheet feeding apparatus is arranged in the sheet conveying line and discrete and independent motor $M_1$ and $M_2$ are provided.

Figure 12A:
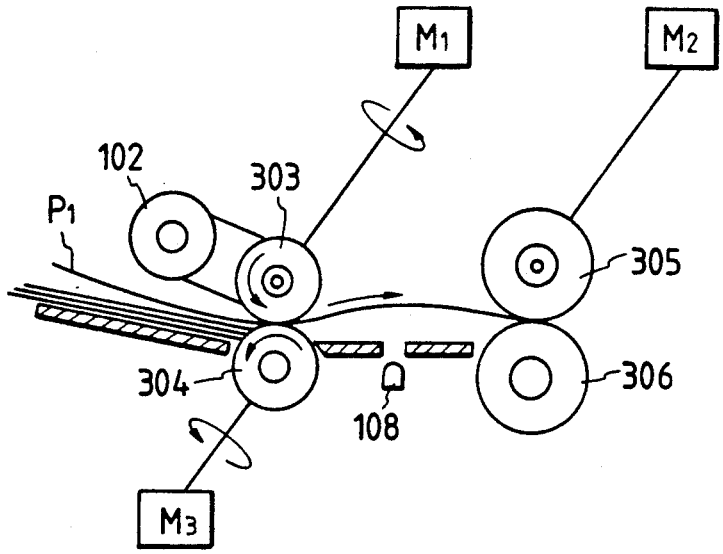
FIGS. 12A to 12C are explanatory views showing the operation of a sheet feeding apparatus according to a fifth embodiment of the present invention.

In FIG. 12A, the motor $M_2$ is stopped, and thus, a second pair of rotatable rollers 305, 306 are not rotated. The motor $M_1$ is being rotated in the anti-clockwise direction, whereby a feed roller 303 among a first pair of rotatable rollers is rotated in the sheet feeding direction. A motor $M_3$ is being rotated in the anti-clockwise direction, whereby a separating roller 304 among the first pair of rollers is rotated in the sheet returning direction. In this way, only one sheet $P_1$ is separated from the sheet stack and is fed in the sheet feeding direction until a loop is formed in the sheet after a leading end of the sheet has been abutted against the second pair of rollers 305, 306 (now stopped).

Incidentally, in this case, the second pair of rollers 305, 306 may be rotated in the sheet feeding direction by rotating the motor $M_2$ in the anti-clockwise direction. By rotating these rollers 305, 306 in this way, the leading end of the sheet is apt to be inserted into the nip between the rollers 305 and 306 even when the leading end portion of the sheet is curled.

Figure 12B:
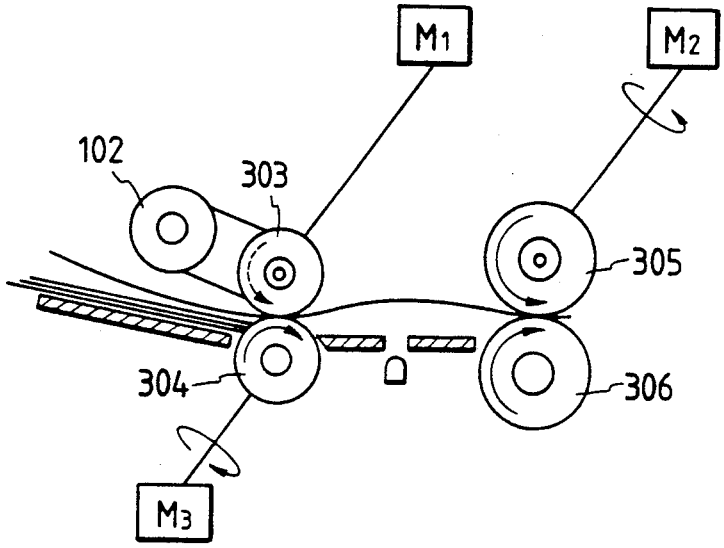

In FIG 12B, the motor $M_2$ starts to rotate in the anti-clockwise direction to start the conveying of the sheet. In this case, the motor $M_3$ is rotated in the clockwise direction for a very short time to rotate the separating roller 304 in the sheet feeding direction. The motor $M_1$ is stopped, and thus, the feed roller 303 is rotated in the anti-clockwise direction by following the movement of the sheet.

Figure 12C:
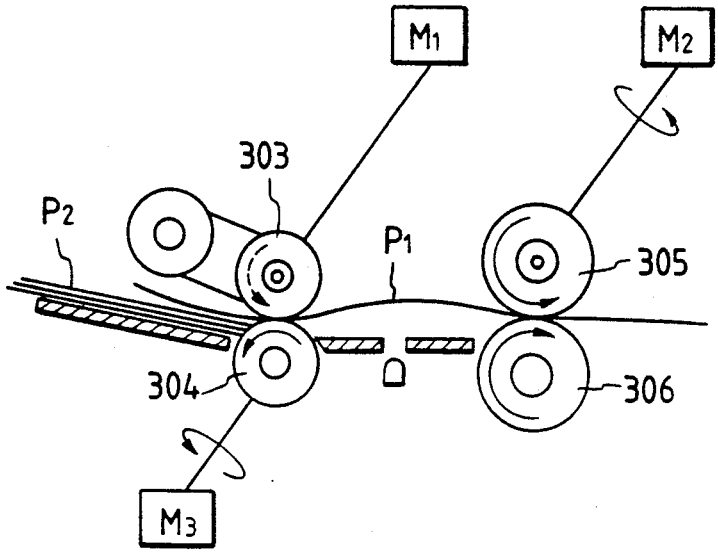

In FIG. 12C, the motor $M_2$ continues to rotate in the anti-clockwise direction and the motor $M_1$ is still stopped. The motor $M_3$ is rotated in the anti-clockwise direction to rotate the separating roller 304 in the sheet returning direction, whereby the uppermost sheet $P_1$ can be fed smoothly and the second and other sheets are prevented from double-feeding together with the uppermost sheet.

Incidentally, while various examples were explained as mentioned above, the rollers 205, 206 of FIGS. 10 and 11, and the rollers 305, 306 of FIG. 12 may be resist rollers, for example, arranged at an upstream side of a photosensitive member of a copying machine, or may be conveying rollers which can take the timing and remove the skew-feed during the feeding of the sheet.

What is claimed is:

1. A sheet feeding apparatus comprising:

first rotary means for feeding a sheet material, second rotary means arranged at a downstream side of said first rotary means in a sheet feeding direction, for further feeding the sheet material;

a driving source for rotating said first and second rotary means;

transmitting means adapted to be engaged to rotate said first rotary means in the sheet feeding direction and to be disengaged to stop said second rotary means, when said driving source is rotated in one direction, and adapted to be disengaged to stop said first rotary means and to be engaged to rotate said second rotary means in the sheet feeding direction, when said driving source is rotated in the other direction; and prohibiting means for preventing rotation of said first rotary means in a sheet returning direction at the start of rotation of said driving source in the other direction.

2. A sheet feeding apparatus according to claim 1, wherein said prohibiting means comprises a temporary decoupling means for releasing a connection between said driving source and said transmitting means for said first rotary means.

3. A sheet feeding apparatus according to claim 2, wherein said temporary decoupling means comprises coupling means having a play portion for interrupting rotation of said driving source temporarily upon rotation starting thereof in the opposite direction, and wherein said coupling means is disposed between said driving source and said transmitting means.

4. A sheet feeding apparatus according to claim 3, wherein said coupling means comprises a gear rotated by a motor, and a rotary shaft attached to said gear with a play therebetween.

5. A sheet feeding apparatus according to any one of claims 1 to 4, wherein said first rotary means comprises a feed rotary member and a separating rotary member, and wherein said transmitting means is adapted to temporarily stop and to thereafter rotate said separating rotary member in the sheet returning direction when said driving source is rotated in the other direction.

6. A sheet feeding apparatus according to claim 1, wherein said prohibiting means comprises a coupling means for connecting said driving source and said transmitting means for said first rotary means in the sheet feeding direction.

7. A sheet feeding apparatus according to claim 1, wherein said first rotary means comprises feed rotary member and a separating rotary member, and wherein said transmitting means is adapted at first to temporarily rotate said separating rotary member in the sheet feeding direction and thereafter to rotate said separating rotary member in the direction opposite to the sheet feeding direction, when said driving source is rotated in the other direction.

8. A sheet feeding apparatus according to claim 7, wherein said transmitting means has a first means adapted to be engaged to rotate said separating rotary member in a reverse direction when said driving source is rotated in the one direction, and a second means adapted to be engaged to rotate said separating rotary member in the reverse direction when said driving source is rotated in the other direction; wherein said prohibiting means comprises a temporary decoupling means disposed between said driving source and said second system, for temporarily releasing a connection between said driving source and said second means at the beginning of the rotation of said driving source in the other direction; and wherein said first means rotates said separating rotary member in the sheet feeding direction at the beginning of the rotation of said driving source in the other direction.

9. A sheet feeding apparatus according to claim 8, wherein said temporary decoupling means comprises coupling means having a play portion for interrupting rotation of said driving source temporarily upon rotation starting thereof in the opposite direction, and wherein said coupling means is disposed between said driving source and said transmitting means.

10. A sheet feeding apparatus according to claim 9, wherein said coupling means comprises a gear rotated by a motor of said driving source, and a rotary shaft attached to said gear with a play therebetween.

11. A sheet feeding apparatus comprising:

first rotary means including a feed rotary member and a separating rotary member and adapted for separating and feeding sheet materials one by one;

second rotary means arranged at a downstream side of said first rotary means in a sheet feeding direction, for further feeding the sheet materials; and a control means for rotating said feed rotary member in the sheet feeding direction and said separating rotary member in a sheet returning direction and for stopping said second rotary means, during the separating and feeding of the sheet material, and for rotating said second rotary means in the sheet feeding direction after the separating and feeding of the sheet materials is finished, and for rotating said separating rotary member in the sheet feeding direction for a predetermined time at the beginning of the rotation of said second rotary means in the sheet feeding direction.

12. A sheet feeding apparatus according to claim 11, wherein said feed rotary member is stopped after said separating and feeding of the sheet material is finished, said feed rotary member comprising a clutch for permitting the rotation of said feed rotary member in the sheet feeding direction by the movement of the sheet material; and said separating rotary member is so constructed to rotate in the sheet returning direction at a timing when the sheet material is pinched by said second rotary means.

13. A sheet feeding apparatus comprising:

first rotary means for feeding a sheet material;

second rotary means arranged at a downstream side of said first rotary means in a sheet feeding direction, for further feeding the sheet material;

a driving source for rotating said first and second rotary means; transmitting means adapted to be engaged to rotate said first rotary means in the sheet feeding direction and to rotate said second rotary means in a sheet returning direction, when said driving source is rotated in one direction, and adapted to be disengaged to stop said first rotary means and engaged to rotate said second rotary means in the sheet feeding direction, when said driving source is rotated in the other direction; and prohibiting means for preventing rotation of said first rotary means in a sheet returning direction at the start of rotation of said driving source in said the other direction.

14. A sheet feeding apparatus comprising:

first rotary means including a feed rotary member and separating rotary member and adapted for separating and feeding sheet materials one by one;

second rotary means arranged at a downstream side of said first rotary means in a sheet feeding direction, for further feeding the sheet materials; and rotation control means for rotating said feed rotary member in the sheet feeding direction and said separating rotary member in a sheet returning direction and for rotating said second rotary means reversely, during the separating and feeding of the sheet materials, and for rotating said second rotary means in the sheet feeding direction after the separating and feeding of the sheet materials is finished, and for rotating said separating rotary member in the sheet feeding direction for a predetermined time at the beginning of the rotation of said second rotary means in the sheet feeding direction.

15. An image reading apparatus comprising:

first rotary means for feeding a sheet material, second rotary means arranged at a downstream side of said first rotary means in a sheet feeding direction, for further feeding the sheet material, reading means for reading an image on the sheet fed from said second rotary means;

a driving source for rotating said first and second rotary means;

transmitting means adapted to be engaged to rotate said first rotary means in the sheet feeding direction and to be disengaged to stop said second rotary means, when said driving source is rotated in one direction, and adapted to be disengaged to stop said first rotary means and to be engaged to rotate said second rotary means in the sheet feeding direction, when said driving source is rotated in the other direction; and prohibiting means for preventing rotation of said first rotary means in a sheet returning direction at the start of rotation of said driving source in the other direction.

16. An image reading apparatus comprising:

first rotary means including a feed rotary member and a separating rotary member and adapted for separating and feeding sheet materials one by one;

second rotary means arranged at a downstream side of said first rotary means in a sheet feeding direction, for further feeding the sheet material;

reading means for reading an image on the sheet fed from said second rotary means; and control means for rotating said feed rotary member in the sheet feeding direction and said separating rotary member in a sheet returning direction and for stopping said second rotary means, during the separating and feeding of the sheet material, and for rotating said second rotary means in the sheet material, and for rotating said second rotary means in the sheet feeding direction after the separating and feeding of the sheet materials is finished, and for rotating said separating rotary member in the sheet feeding direction for a predetermined time at the beginning of the rotation of said second rotary means in the sheet feeding direction.

17. An image reading apparatus comprising:

first rotary means for feeding a sheet material;

second rotary means arranged at a downstream side of said first rotary means in a sheet feeding direction, for further feeding the sheet material;

reading means for reading an image on the sheet fed from said second rotary means;

a driving source for rotating said first and second rotary means;

transmitting means adapted to be engaged to rotate said first rotary means in the sheet feeding direction and to rotate said second rotary means in a sheet returning direction, when said driving source is rotated in one direction, and adapted to be disengaged to stop said first rotary means and engaged to rotate said second rotary means in the sheet feeding direction, when said driving source is rotated in the other direction; and prohibiting means for preventing rotation of said first rotary means in a sheet returning direction at the start of rotation of said driving source in said the other direction.

18. An image reading apparatus comprising:

first rotary means including a feed rotary member and a separating rotary member and adapted for separating and feeding sheet materials one by one;

second rotary means arranged at a downstream side of said first rotary means in a sheet feeding direction, for further feeding the sheet material;

reading means for reading an image on the sheet fed from said second rotary means; and rotation control means for rotating said feed rotary member in the sheet feeding direction and said separating rotary member in a sheet returning direction and for rotating said second rotary means reversely, during the separating and feeding of the sheet materials, and for rotating said second rotary means in the sheet feeding direction after the separating and feeding of the sheet materials is finished, and for rotating said separating rotary member in the sheet feeding direction for a predetermined time at the beginning of the rotation of said second rotary means in the sheet feeding direction.

* * * * *